US006407506B1

(12) United States Patent
Naka et al.

(10) Patent No.: US 6,407,506 B1
(45) Date of Patent: Jun. 18, 2002

(54) DISPLAY APPARATUS, DISPLAY METHOD AND CONTROL-DRIVE CIRCUIT FOR DISPLAY APPARATUS

(75) Inventors: Kazutaka Naka, Yokohama; Michitaka Ohsawa, Fujisawa; Akihiko Kougami, Akashi; Hiroshi Ohtaka, Yokohama, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/539,623

(22) Filed: Mar. 31, 2000

(30) Foreign Application Priority Data

Apr. 2, 1999 (JP) ..... 11-096816

(51) Int. Cl.[7] ..... G09G 3/20

(52) U.S. Cl. ..... 315/169.1; 315/169.3; 345/60

(58) Field of Search ..... 315/169.3, 160, 315/169.1, 169.2; 345/60, 61, 63

(56) References Cited

U.S. PATENT DOCUMENTS 6,204,833 B1 * 3/2001 Hayashi et al. ..... 345/58

FOREIGN PATENT DOCUMENTS

JP 1124628 1/1999

* cited by examiner

*Primary Examiner*—David Vu

(74) *Attorney, Agent, or Firm*—Antonelli, Terry, Stout & Kraus LLP

(57) ABSTRACT

This specification and drawings disclose a display technology which displays an image by illuminating pixels of a display unit. The apparatus comprises an image signal processing circuit which processes an input image signal, a control circuit which controls display resolution information relating to the image displayed on the display unit, and a drive circuit which drives the display unit based on the output of an input signal processing circuit and the control circuit. The display resolution information is limited by the control circuit, and an image corresponding to an input image signal is displayed on the display unit when a time during which illuminated pixels are selected on the display unit, is shortened.

36 Claims, 10 Drawing Sheets f0 = (P1+P2) / 2 O1 = f0 + f1'
f1 = (P1- P2) / 2 O2 = f0 - f1'

DISPLAY APPARATUS, DISPLAY METHOD AND CONTROL-DRIVE CIRCUIT FOR DISPLAY APPARATUS

BACKGROUND OF THE INVENTION

This invention relates to a display technique for a display, and in particular relates to a technique for displaying an image by illuminating pixels of a display unit.

An example of such display is a plasma display which is of interest because it can easily be adapted to large panels.

In this plasma display, the sub field method is generally used wherein intermediate gradations between light-emitting and non-light emitting are displayed. In this method, one field period is formed from plural periods to which unique light-emitting weightings are assigned, and brightness gradation is represented by controlling the illumination and non-illumination of pixels (cells) in each sub field. In a plasma display wherein an address operation which specifies pixels to be illuminated and a sustain operation, wherein the specified pixels are illuminated (made to emit light), are performed at different times, i.e., the so-called address/sustain separation method, one sub field period comprises a reset period which initializes the state of the cells (pixels), an address period which controls the illumination/non-illumination of the cells (pixels), and a sustain period which determines the light amount emitted by each cell when it is illuminated. These periods are respectively controlled by control pulses having a predetermined time width.

In the address period, address processing is performed corresponding to lines based on data which controls the illumination/non illumination of the pixels, so with high-resolution panels which have a large number of lines, the address period requires a considerable time. If it is attempted to deal with this problem by shortening the sustain period, sufficient brightness cannot be obtained due to the reduction of pixel light-emitting time, and if it is attempted to deal with a problem by reducing the number of sub fields in one field period, a sufficient gradation cannot be obtained. For example, it is attempted to construct a high resolution panel having a vertical resolution of 1000 lines where the address processing time is 2 $\mu$s per line, an address period of 2 ms (=2 $\mu$s×1000 lines) per sub field is required. In general, it is said that a gradation of about 256 (8 bits) is required to display an image without deterioration of the image signal. If eight sub fields are formed in one field period (approx. 16.6 ms) using this 2 ms address period per sub field, the total address period in one field is 16 ms (=2 ms×8), so nearly all of one field period is taken up by the address period. As a result, there is practically no time left to allot to the sustain period in one field period, so not enough time is available for panel illumination and the brightness of the image decreases. Also, if the number of sub fields is decreased from, for example, 8 to 6, and the number of gradations is decreased from 256 to 64, a sufficient number of gradations cannot be displayed and the image quality deteriorates.

Another problem inherent in the sub field method is that of false contour which causes the quality of moving images to degenerate. To reduce false contour, the distribution and center of light emission in one field is usually controlled. If the number of gradations that can be displayed is fixed, the number of light-emitting patterns that can be controlled may be increased by increasing the number of sub fields and there is then a large false contour reduction, but if a sufficient number of sub fields cannot be obtained, it is difficult to reduce false contours.

In the prior art display apparatus, the aim was to faithfully display the input signal, and techniques were used to improve image quality taking account of human visual characteristics, such as dither or error scatter processing to partially compensate for insufficient number of gradations, or control of average brightness, but all these techniques only controlled signal amplitude.

An example of the related art is that of Japanese Unexamined Patent Publication No. Hei 11-24628. In this publication, a technique is disclosed for shortening the address period by interlace scanning in sub fields corresponding to lower bits, and also a method for performing a write-in operation by selecting two scanning electrodes simultaneously instead of interlace scanning, but the specific signal-generating technique used is not disclosed.

Each line of the image signal is data sampled in the vertical direction of one screen, and in order to interpolate the sampling data by interlace scanning, the vertical resolution must first largely be reduced to, for example, one half so as to reduce clinch disturbance. In other words, in the prior art interpolation of sampling data, the resolution of the display panel could not be maintained and a high-quality display could not be obtained.

If sampling data was interpolated without largely reducing the vertical resolution to about half beforehand, high frequency signal components were converted to low-frequency signal components due to clinch disturbance and image quality deteriorated.

If the lower bits of adjacent upper and lower data are unconditionally made the same, the display data may largely vary and image quality may considerably deteriorate. For this reason, some kind of processing is necessary. For example, with upper and lower adjacent pixel data , when the upper pixel data is level 16 and the lower pixel data is level 15, in a sub field representation with a light-emission weighting having a power of 2, level 16 is represented by [1,0,0,0] (1 is a light-emitting sub field and 0 is a light extinction sub field starting from the upper sub field), and level 15 is [0,1,1,1,]. Here, assuming the same data by interpolating the sub fields corresponding to the lower three bits at a rate of one line in two according to interlace criteria, the lower three sub fields [1,1,1] of level 15 [0,1,1,1] of the lower pixel are replaced by the lower three sub fields [0,0,0] of level 16 [1,0,0,0,] of the upper pixel. As a result, the level which is displayed is [0,0,0,0], and a pixel at level 15 becomes a pixel at level 0. Conversely, if the lower three sub fields [1,0,0,] of level 16 of the upper pixel are replaced using the lower three sub fields [1,1,1] of level 15 of the lower pixel, the upper pixel at level 16 becomes level 31 [1,1,1,1]. This extreme level fluctuation is responsible for flicker.

This invention aims to suppress this type of level fluctuation and decrease of resolution by, for example, performing processing so that data in predetermined sub fields becomes the same, and for example processing lower sub fields by referring to signals for common, plural lines.

SUMMARY OF THE INVENTION

It is therefore an object of this invention to solve the above problems inherent in the prior art, and to provide a display technique which can produce a high resolution, finely graded image.

To achieve the above object, in this invention, the necessary number of sub fields and display period length are achieved by making full use of human visual characteristics and the statistical characteristics of the image signal, and limiting the amount of resolution information in the display image to shorten the address period.

This invention therefore provides the following:

1) A display apparatus which displays an image by illuminating pixels of a display unit, the apparatus comprising an input signal processing circuit which processes an input image signal, a control circuit which controls display resolution information relating to an image displayed on the display unit, and a drive circuit which drives the display unit based on the outputs of the input signal processing circuit and control circuit, wherein an image corresponding to the input image signal is displayed by driving the display unit with the drive circuit when the display resolution information is limited by the control circuit, and the illuminated pixel selection time of the display unit is shortened.

2) A display apparatus using a sub field which illuminates addressed pixels of a display unit to display an image, comprising an image signal processing circuit which performs sub field conversion processing on an input image signal, a control circuit which controls display resolution information of an image displayed on the display unit and a drive circuit which addresses and illuminates pixels of the display unit based on the outputs of the input signal processing circuit and control circuit, wherein an image corresponding to the input image signal is displayed by driving the display unit with the drive circuit when the display resolution information is limited by the control circuit, and the address period which selects the illuminated pixels of the display unit is shortened.

3) A display apparatus using a sub field which illuminates addressed pixels of a display unit to display an image, comprising a display unit on which the pixels are arranged in plural lines,an image signal processing circuit which converts an input image signal into sub field data showing illumination or extinction of each sub field, a smoothing circuit which performs control so that bit data of the sub field data are arranged in the plural lines of the display unit, a control circuit which controls the address periods of the sub fields so as to arrange the bit data, and a drive circuit which addresses and illuminates pixels of the display unit based on the outputs of the image signal processing circuit, smoothing circuit and control circuit, wherein the image is displayed by driving the plural lines of the display unit while performing control to shorten address periods in predetermined sub fields, and arranging the bit data.

4) A display apparatus using a sub field which illuminates addressed pixels of a display unit to display an image, comprising a display unit on which pixels are formed in intersecting parts where first line electrodes and second line electrodes are arranged to intersect, a conversion circuit which converts an input image signal to sub field data, a smoothing circuit which performs control so that bit data of the sub field data are arranged in plural lines of second line electrodes of the display unit, a control circuit which controls the address periods of the sub fields in which the bit data are arranged, and a drive circuit which forms a drive signal that drives the display unit based on the output of the control circuit, addresses pixels by driving at least the first line electrodes and illuminates the addressed pixels by driving the second line electrodes, wherein the image is displayed by driving the plural lines of second line electrodes of the display unit while controlling address periods in predetermined sub fields, and arranging the bit data.

5) A display method for displaying an image by illuminating pixels of a display unit, comprising an input signal processing step for processing an input image signal, a control step for controlling display resolution information of an image displayed on the display unit and a drive step for driving the display unit based on the outputs formed by the input signal processing step and control step, wherein an image corresponding to the input image signal is displayed by driving the display unit when the display resolution information is limited and the illuminated pixel selection time of the display unit is shortened.

6) A display method using a sub field for illuminating addressed pixels of a display unit to display an image, comprising an image signal processing step for performing sub field conversion processing on an input image signal, a control step which controls display resolution information of an image displayed on the display unit, and a drive step which addresses and illuminates pixels of the display unit based on the outputs of the input signal processing step and control step, wherein an image corresponding to the input image signal is displayed by driving the display unit when the display resolution information is limited by the control circuit, and the address periods are shortened.

7) A display method using a sub field for addressing and illuminating pixels of a display unit on which the pixels are arranged in plural lines so as to display an image, comprising an image signal processing step for converting an input image signal into sub field data showing illumination or extinction of each sub field, a smoothing step for performing control so that bit data of the sub field data are arranged in the plural lines, a control step for controlling address periods of the sub fields in which the bit data are arranged, and a drive step for addressing and illuminating pixels of the display unit based on the outputs of the image signal processing step, smoothing step and control step, wherein the image is displayed by driving the plural lines of the display unit while controlling address periods in predetermined sub fields, and arranging the bit data.

8) A control-drive circuit for driving a display apparatus which displays an image by illuminating pixels of a display unit, comprising an input signal processing circuit which processes an input image signal, a control circuit which controls display resolution information of an image displayed on the display unit, and a drive circuit which drives the display unit based on the outputs of the input signal processing circuit and control circuit, wherein an image corresponding to the input image signal is displayed by driving the display unit with the drive circuit when the display resolution information is limited by the control circuit, and the illuminated pixel selection time of the display unit is shortened.

9) A control-drive circuit for driving a display apparatus using a sub field which illuminates addressed pixels of a display unit to display an image, comprising an image signal processing circuit which performs sub field conversion processing on an input image signal, a control circuit which controls display resolution information of an image displayed on the display unit, and a drive circuit which addresses and illuminates pixels of the display unit based on the outputs of the input signal processing circuit and control circuit, wherein the display resolution information in predetermined sub fields is limited by the control circuit, and the address periods of the display unit are shortened by the drive circuit.

10) A control-drive circuit for a display apparatus using a sub field which illuminates addressed pixels of a display unit to display an image, comprising an image signal processing circuit which converts an input image signal into sub field data showing illumination or extinction of each sub field, a smoothing circuit which performs control so that bit data of the sub field data are arranged in plural lines of the display unit, a control circuit which controls address periods of the sub fields to arrange the bit data, and a drive circuit which addresses and illuminates pixels of the display unit based on the outputs of the image signal processing circuit, smoothing circuit and control circuit, wherein a drive output which controls address periods in predetermined sub fields and arranges the bit data is obtained as an output for driving the plural lines of the display unit.

DETAILED DESCRIPTION OF THE PREFERRED EMBODIMENTS

Figure 1:
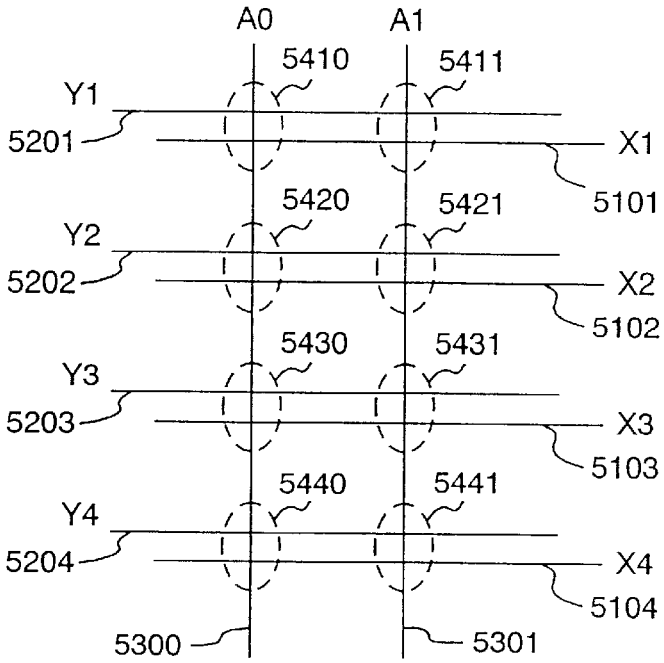
FIG. 1 is a schematic view of discharge cells and electrodes in a plasma display.

Specific embodiments of this invention will hereafter be described referring to the drawings.

FIG. 1 shows a schematic view of the arrangement of discharge cells and electrodes in an ordinary AC 3 electrode plasma display. In FIG. 1, 5101, 5102, 5103, 5104 are X sustain electrodes, 5201, 5202, 5203, 5204 are Y sustain electrodes, and 5300 and 5301 are address electrodes.

The address electrodes 5300 and 5301 are formed on a rear face plate, and the X sustain electrodes 5101–5104 and Y sustain electrodes 5201–5204 are formed on a front face plate. Pixels are formed at the intersections of electrode pairs of X sustain electrodes and Y sustain electrodes, and the address electrodes. Due to discharges between these electrodes, pixels 5410, 5411, 5420, 5421, 5430, 5431, 5440 and 5441 are formed on a panel as shown in FIG. 1.

Figure 2:
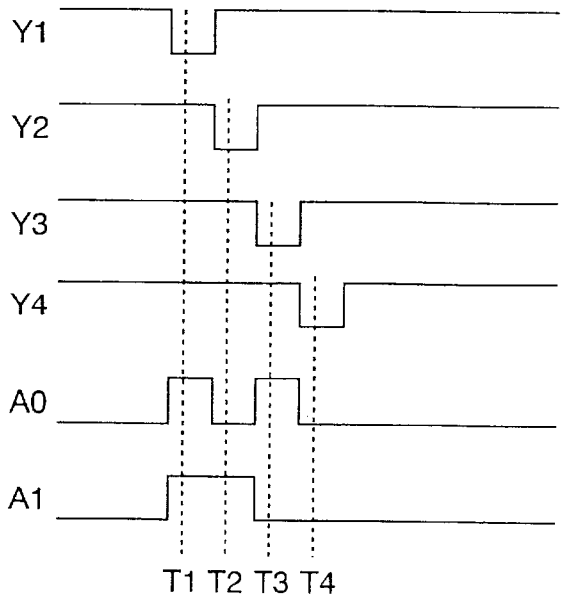
FIG. 2 (PRIOR ART)
FIG. 2 is a descriptive diagram of electrode applied voltages in an address period according to the prior art.

FIG. 2 is a diagram of the applied voltages of the Y sustain electrodes 5201–5204 and address electrodes 5300–5301 in an address period according to the prior art.

As shown in FIG. 2, a scanning pulse is applied in the sequence Y1 sustain electrode 5201, Y2 sustain electrode 5202, Y3 sustain electrode 5203 and Y4 sustain electrode 5204, and an address pulse which controls illumination/non-illumination of every line is applied to the A0 address electrode 5300 and A1 address electrode 5301.

Here, the scanning pulse is applied to the Y1 sustain electrode 5201 at a time T1 to control illumination/non-illumination of the pixels 5410, 5411 in the first line. In this example, an address voltage is applied to both the A0 address electrode 5300 and A1 address electrode 5301, so an address discharge occurs between the A0 address electrode and Y1 sustain electrode, and between the Al address electrode and Y1 sustain electrode, which permits illumination in the sustain period after a wall charge is formed. Subsequently, address processing which controls illumination/non-illumination is performed for the pixels 5420, 5421 in the second line at a time T2, for the pixels 5430, 5431 in the third line at a time T3, and for the pixels 5440, 5441 at a time T4, respectively. Due to this address processing per line, wall charges are formed in the cells, and the light emission in the sustain period is controlled.

Figure 3:
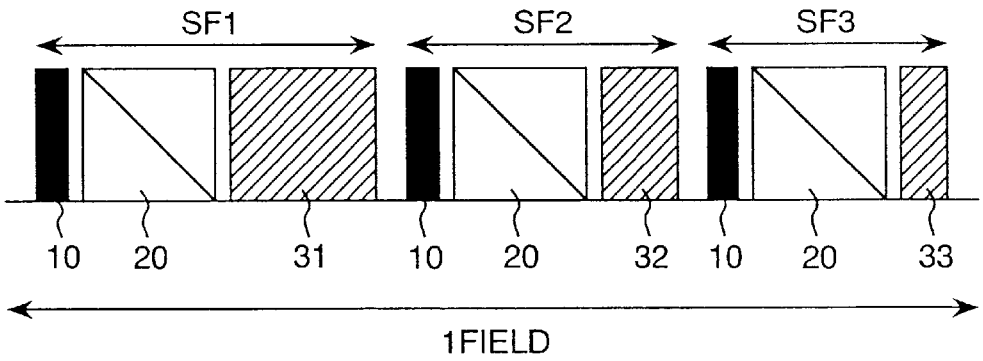
FIG. 3 (PRIOR ART)
FIG. 3 is a diagram showing an example of a field arrangement according to the prior art.

FIG. 3 is a descriptive drawing of the prior art technique, and shows a typical field arrangement wherein one field comprises three sub fields (SF1, SF2, SF3).

In FIG. 3, 10 is a reset period for initializing the state of the discharge cells in each sub field, 20 is an address period which controls the illumination/non-illumination of the pixels in each sub field, and 31, 32, 33 are sustain periods which determine the light emission amounts in the respective sub fields.

In these sustain periods 31, 32, 33, for discharge cells wherein a wall charge was formed in the address period 20, light emission occurs according to the number of sustain pulses. In this sub field scheme, a light emission weighting corresponding respectively to the sub fields SF1–SF3 is assigned to represent gray scale. In the example of FIG. 3, the number of sustain pulses in the sustain periods 31, 32, 33 of the sub fields SF1–SF3 is arranged to be approximately 4:2:1 in proportion to the light emission weighting of each sub field. In this way, it is possible to represent a level of 0 where none of the sub fields SF1–SF3 emit light, to a level of 7 (=3+2+1) where all the sub fields SF1–SF3 emit light. Here, the maximum brightness (level 7) which can be displayed is determined by the sum of the number of sustain pulses in each of the sustain periods 31, 32, 33 of the sub fields SF1–SF3. Therefore, if the time which does not contribute to light emission in one field, e.g., the address period 20, becomes too long, sufficient brightness cannot be maintained, and it will no longer be possible to obtain a good image. An address period 20 proportional to the number of display lines is required for one sub field. For this reason, if it is attempted to manufacture a display panel of high resolution, a sufficient number of sub fields cannot be provided, the gradation of the display will be inadequate, the brightness will decline and the image will deteriorate.

Figure 4:
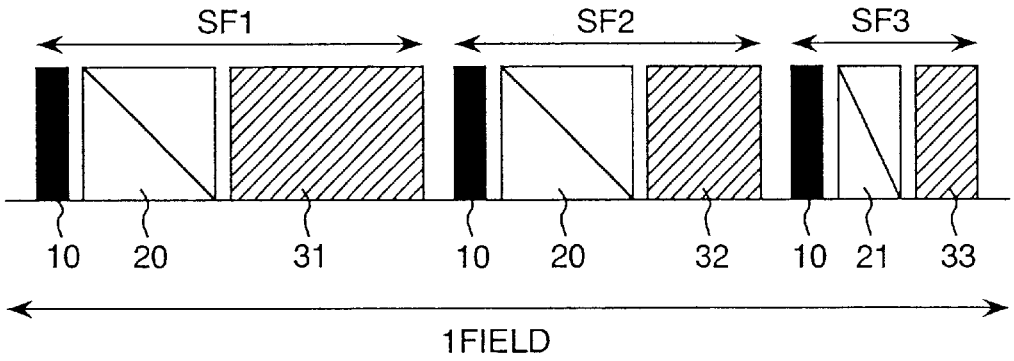
FIG. 4 is a diagram showing a field arrangement according to a first embodiment of this invention.

FIG. 4 relates to a first embodiment of this invention, and is a drawing of a typical field arrangement where the address period of the lower sub field SF3 which has a small light emission weighting is set to one half of that in the conventional frame arrangement shown in FIG. 3.

In FIG. 4, 21 is the address period of the lower sub field SF3, and it is one half of that in FIG. 3.

In FIG. 4, in the sub fields SF1, SF2, as in the case shown in FIG. 3, discharge cells are initialized in the reset period 10, and illumination/non-illumination pixels are selected for every line in the address period 20. In the sustain periods 31 and 32, the pixels chosen in the address period 20 are made to emit light according to their respective light emission weighting. In the sub field SF3, in the address period 21 which follows the reset period 10, address control processing is performed in half the time per line by performing address processing on two adjacent lines simultaneously.

Figure 5:
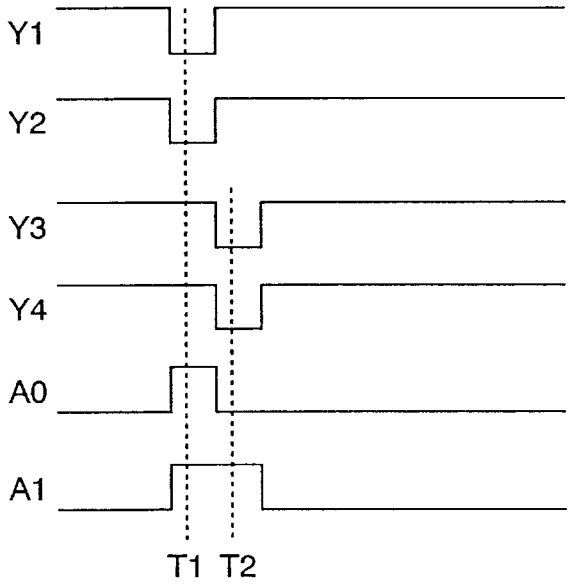
FIG. 5 is a descriptive diagram of electrode applied voltages in an address period according to the first embodiment of this invention.

FIG. 5 is a descriptive drawing relating to this embodiment, and shows the voltages applied to the Y sustain electrodes 5201–5204 and address electrodes 5300–5301 in the address period.

As shown in this figure, for the Y1 sustain electrode 5201 and Y2 sustain electrode 5202, address processing is performed using identical data for two lines simultaneously by simultaneously applying scanning pulses. After the Y1 sustain electrode 5201 and Y2 sustain electrode 5202, address processing of the Y3 sustain electrode 5203 and Y4 sustain electrode 5204 is performed simultaneously. Thus, by simultaneously applying a scanning pulse to and addressing two lines at a time, the time required to scan all the lines on the screen can be shortened to one half.

In the example shown in FIG. 5, address processing was performed on two lines simultaneously, but three or four lines may also be processed simultaneously in which case the required address time is 1/3 or 1/4. Further, this shortening of the address period is not limited to the lowest sub field SF3 with the smallest light emission weighting, and may be performed for the sub field SF2 or to both the sub fields SF2, SF3. Another possibility is to perform address processing on two lines simultaneously for the sub field SF2 to shorten the processing time to 1/2, and to perform address processing on three lines simultaneously for the sub field SF3 to shorten the processing time to 1/3. Due to this processing, although vertical resolution information in lower sub fields with small light emission weighting will be lost, flat parts of the image can be displayed smoothly without any problem and signals for edge parts can be reproduced by higher sub fields with a large light emission weighting, so a bright image can be displayed with hardly any image deterioration.

Hence, according to this embodiment, by reducing the number of address control data in a specific sub field, address periods which do not directly contribute to light emission in one field are shortened, and the shortened parts can be added to the sustain periods 31, 32, 33 to extend these periods to gain higher brightness, or the number of sub fields can be increased by these shortened parts to gain higher image quality.

According to this embodiment, address processing is performed on two adjacent lines simultaneously by identical data. Due to image correlations, similar data tends to be obtained between neighboring pixels, and as processing is performed on the sub field SF3 which has a small light emission weighting, the address processing time can be shortened with almost no image deterioration.

Figure 6:
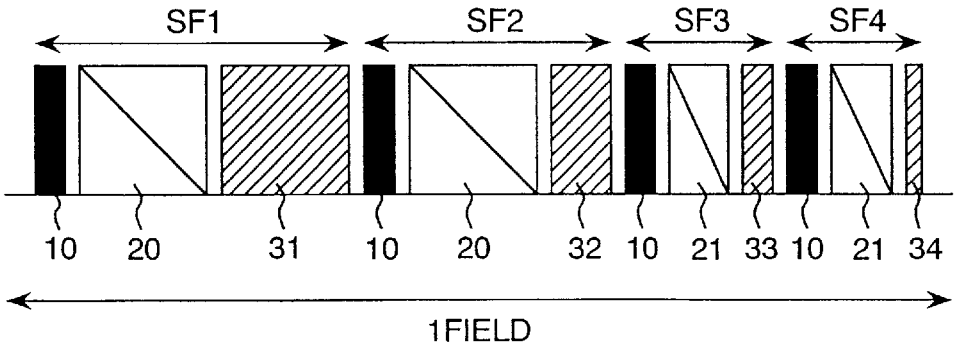
FIG. 6 is a diagram showing a field arrangement according to a second embodiment of this invention.

FIG. 6 shows a second embodiment of this invention wherein a sub field SF4 is added to the frame arrangement of the prior art shown in FIG. 3, and the address periods of the lower sub fields SF3–SF4, which have a low light emission weighting, are set to 1/2.

In FIG. 6, 21 is the address period of the sub fields SF3, SF4, and is half that shown in FIG. 3. 34 is the sustain period of the sub field SF4. The remaining features correspond to features of FIG. 3 designated by the same symbols.

In FIG. 6, in the sub fields SF1, SF2, the discharge cells are initialized in the reset period 10, and selection processing of illumination/non-illumination pixels is performed for every line in the address period 20, as in the case of FIG. 3. In the sustain periods 31 and 32, the pixels chosen in the address period are made to emit light according to their respective light emission weightings. In the sub field SF3, in the address period 21 following the reset period 10, address processing is performed in half the time by performing address processing on two lines simultaneously, and illumination/non-illumination is controlled two lines at a time by equal data. In the sustain period 33 which follows this, the lines selected by the address processing are made to emit light. Likewise, in the sub field SF4, in the address period 21 which follows the reset period 10, address control processing is performed in half the time by performing address processing on two lines simultaneously, and in the sustain period 34, the cells selected by address processing are made to emit light.

Thus, according to the embodiment of FIG. 6, by making the address period 21 of the sub fields SF3, SF4 half the original period, the four sub fields SF1–SF4 can be provided within one field period, and 16 levels can be displayed by setting the light emission ratio of the sustain periods 31, 32, 33, 34 to 8:4:2:1. In this embodiment, the address period of the sub field SF4 was added, but as the address periods of the sub fields SF3 and SF4 are halved, the sum of the address periods of all the sub fields SF1–SF4 within one field period is almost equal to that of the prior art arrangement shown in FIG. 3. Thus, the number of display levels can be increased while effectively maintaining the same brightness as that of the prior art, and a high quality image can be displayed.

Figure 7:
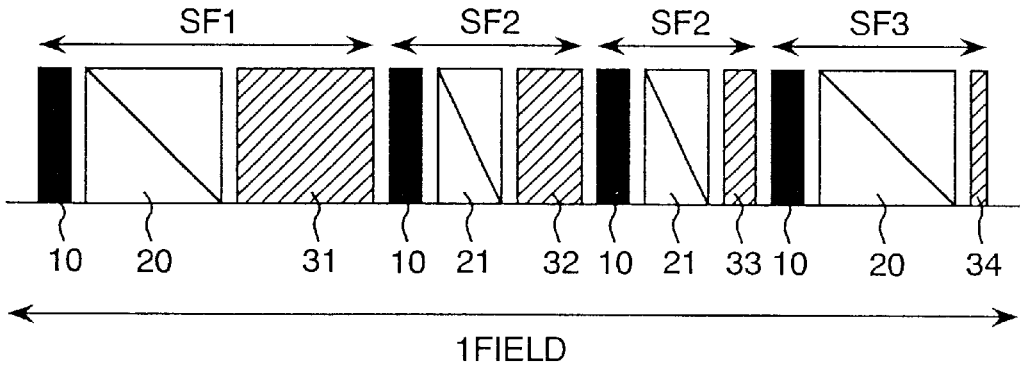
FIG. 7 is a diagram showing a field arrangement according to a third embodiment of this invention.

FIG. 7 shows a third embodiment of this invention wherein the sub field SF4 is added to the prior art frame composition of FIG. 3, and the address periods of the lower sub fields excepting the lowermost sub field SF4 are halved. A numeral 21 is the address period of the sub fields SF2 and SF3, and 34 is the sustain period of the sub field SF4. The remaining features of the arrangement correspond to those of FIG. 3.

In the third embodiment, as shown in FIG. 7, address processing is performed on all lines in the sub fields SF1 and SF4, and address processing is performed by identical data two lines at a time in the sub fields SF2 and SF3.

According to this third embodiment, the address period 21 of the sub fields SF2 and SF3 is approximately half that of the usual address period 20, and the total address period within one field period can be made effectively equal to that of the three sub fields of the prior art method shown in FIG. 3, as in the case of the above-mentioned second embodiment. Hence, the number of display levels can be increased while maintaining effectively the same brightness as that of the prior art.

According to this third embodiment, unlike the aforesaid second embodiment, the lowermost sub field SF4 controls illumination/non-illumination of each line, so image deterioration can be reduced when a pseudo-intermediate gradation such as the dither or error diffusion method is used in conjunction. In the dither or error diffusion method, the average brightness is simulated by turning a minimum gradation step ON or OFF. For example, if the minimum gradation step is set to 1, a level of 0.5 can be simulated by alternately turning this minimum step ON and OFF, hence a finer intermediate gradation can be expressed by changing the ratio of this ON/OFF. Although it is possible to simulate more levels than the real number by applying this pseudo-intermediate gradation, there is the disadvantage that the ON/OFF pattern of the minimum step level is visible as granular noise. In the level representation based on the sub field scheme, this minimum step level corresponds to the light emission amount of the lowermost sub field. Moreover, as a plasma display, etc., does not have the same gamma characteristic as a conventional CRT, the display gradation on the low brightness side tends to be rather coarse. Therefore, if a pseudo-intermediate gradation is applied, interference due to the granular noise produced when it is attempted to simulate the gradation between the black level and the minimum step level when the lowermost sub field is ON, is usually conspicuous. In the above first and second embodiments, the lowermost sub fields SF3 and SF4 in each case are controlled by identical data two lines at a time, and the grain of this granular noise becomes large and causes image deterioration, but in this third embodiment, the lowermost sub field SF4 is controlled for each dot, so interference due to granular noise is suppressed.

It is known that in the case of an ordinary natural image, the differential information amplitude distribution of adjacent pixels is a Laplacian distribution. This has the characteristic that the occurrence frequency of low amplitude differential information near 0 is high, and the occurrence frequency of high amplitude differential information is low. This shows that when attention is directed to two pixels in the vertical direction, the difference between the two is usually 0 (same level) or very small.

In the above first and second embodiments, to control the light emission of the lowermost sub fields SF3 and SF4 by the identical data for two lines, when the difference between the two is 0 (same level), the image can be displayed without any deterioration of quality. On the other hand, in the third embodiment, as the lowermost sub field SF4 is controlled independently in line units, the image can be displayed without any deterioration of quality not only when the difference between the two pixels is 0 (same level), but also when it is within a minimum gradation step.

Hence, according to this third embodiment, by independently controlling the lower sub fields SF2, SF3 including the lowermost sub field SF4, image deterioration can be reduced in the range where an adjacent pixel difference, which occurs frequently, is small.

According to this third embodiment, signals in the edge part of the image which contains a lot of information, although their occurrence frequency is low, are correctly represented by independently controlling the upper sub fields, including the uppermost sub field, so image deterioration can be further reduced by decreasing the address period overall. If this is applied to a high gradation image, for example in the case of eight sub fields SF1–SF8 having a light emission ratio of 128:64:32:16:8:4:2:1, which can represent 256 gradations, the two sub fields SF5, SF6 can be displayed by identical data for two lines, while for the lower sub fields SF7, SF8 including the lowermost sub field, and the upper sub fields SF1, SF2, SF3, SF4 including the uppermost sub field, address control may be performed per line as in the prior art.

As an example of an application of this embodiment, there is also an arrangement wherein a change-over is performed as necessary between a high resolution/low brightness display mode wherein the address period is not shortened at all, and a low resolution/high brightness mode wherein the address period is shortened for a large number of sub fields. For example, when the display is used as a computer monitor or the like, it is set to the high resolution display mode where address periods are not shortened at all, and when it is used to display video signals, a change-over is made to the high brightness display mode where, of the eight sub fields SF1–SF8, the two sub fields SF5, SF6 are displayed using identical data for two lines.

The brightness adjustment range can also be expanded, for example the address period may be shortened for three or more sub fields depending on the brightness of the surroundings where the display apparatus is installed, on user settings, and on image signal levels.

Figure 8:
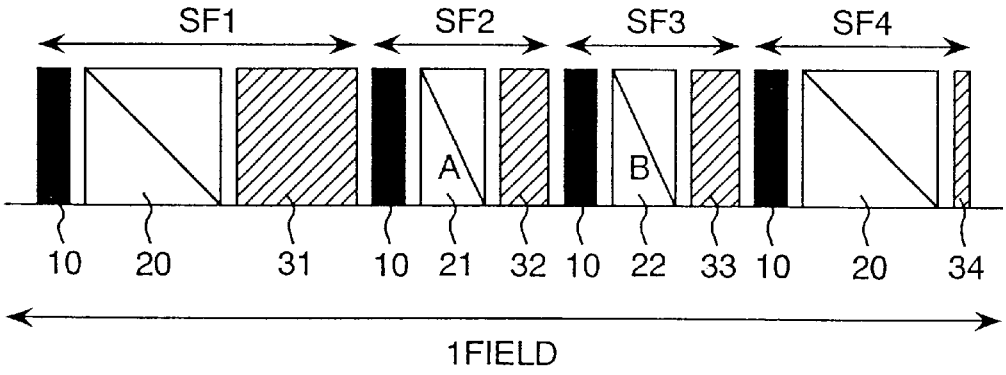
FIG. 8 is a diagram showing a field arrangement according to a fourth embodiment of this invention.

FIG. 8 is a descriptive diagram of a fourth embodiment of this invention wherein, of the sub fields SF1–SF4, the address periods of the lower sub fields SF2, SF3 excluding the lowermost sub field SF4 are set to half, and the light emission ratio of their sustain periods is made identical. A numeral 21 is an address period shortened by data thinning with a first phase of the sub field SF2, 22 is an address period shortened by data thinning with a second phase of the sub field SF3, 32, 33 are sustain periods of the sub fields SF2, SF3 which both have the same light emission ratio, and 34 is the sustain period for the sub field SF4.

According to this fourth embodiment, the light emission ratio of the sub fields SF1–SF4 is not a power of 2 such as 1:2:4:. . . , and the light emission amounts of the sub fields SF2, SF3 are made identical. Specifically, a light emission weighting of, for example, 4:2:2:1 is adopted. By using a light emission ratio different to that of a power of 2, although the number of levels which can be displayed by the same number of sub fields decreases, there is an advantage in that false contour interference which is inherent in the sub field method can be reduced.

Figure 9:
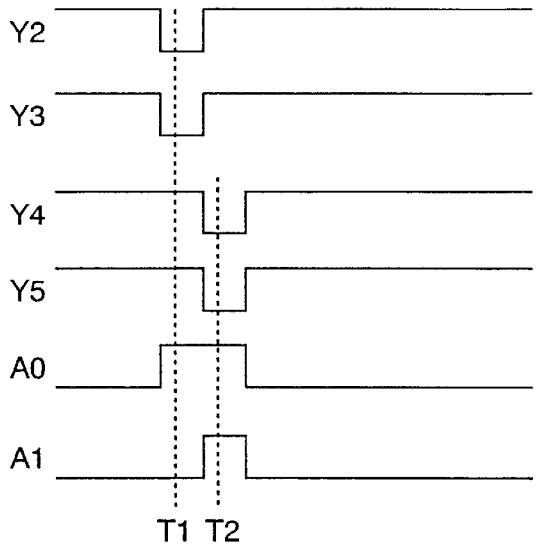
FIG. 9 is a diagram showing an electrode applied voltage in an address period according to the fourth embodiment of this invention.

According to this fourth embodiment, the address periods 21, 22 are compressed for the two sub fields SF2, SF3 which have equal light emission weightings, and data is thinned with different phases for the sub fields SF2, SF3. In the address period 21 of the sub field SF2, as shown in FIG. 5, equal scanning pulses are applied to the Y1 sustain electrode and Y2 sustain electrode, the first line and second line are addressed by identical data, scanning pulses are simultaneously applied to the Y3 sustain electrode and Y4 sustain electrode, and the third line and fourth line are addressed by the same data. However in the address period 22 of the sub field SF3, as shown in FIG. 9, equal scanning pulses are applied to the Y2 sustain electrode and Y3 sustain electrode, the second line and third line are addressed by the same data, scanning pulses are simultaneously applied to the Y4 sustain electrode and Y5 sustain electrode, and the fourth line and fifth line are addressed by identical data. Due to this construction, by making it possible to perform address processing on, for example, the Y2 sustain electrode selecting either identical data to that used for the Y1 sustain electrode or identical data to that used for the Y3 sustain electrode, the optimum processing can be selected and image deterioration due to shortening of the address period can be reduced.

In the method where identical data is used for processing two lines in one pair, the data for the two lines may easily comprise similar values and there is a possibility that the interference known as line pairing may occur. However according to the fourth embodiment, as there are two kinds of line pair processed by identical data, line pairing is not conspicuous. To reduce this line pairing, even in sub fields having different light emission weightings as in the aforesaid second and third embodiments, the phases of the thinned lines can be staggered. Alternatively, the phases of the thinned lines may be changed in field units, for example the lines in the pairs may be changed in odd fields and even fields.

Hence, according to this fourth embodiment, the address period can be shortened while still suppressing false contour interference, and a display apparatus having high brightness or excellent gradation characteristics can be provided.

Figure 10:
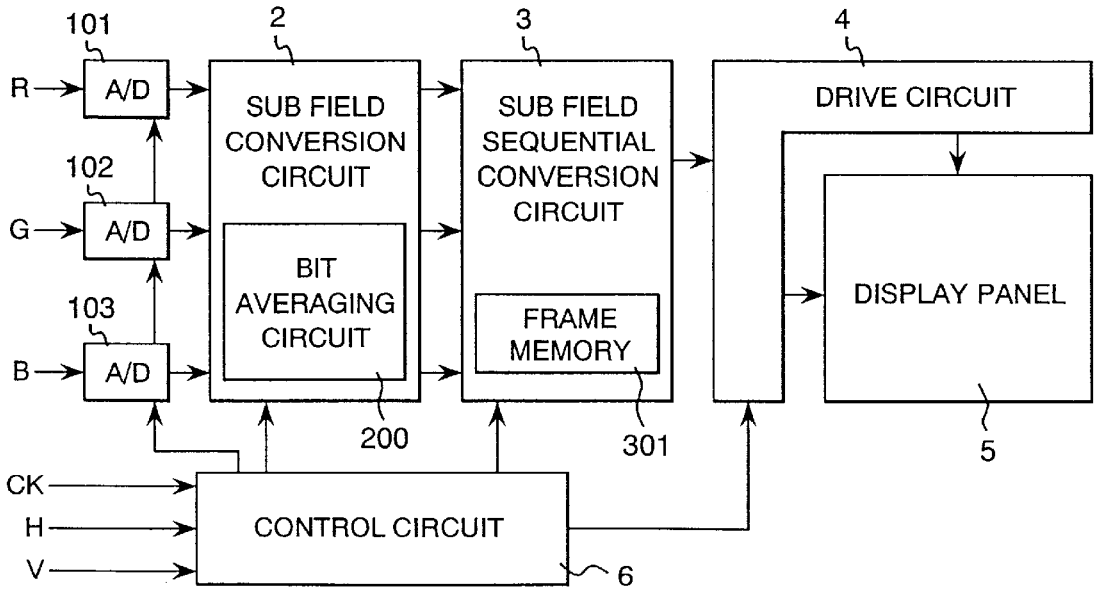
FIG. 10 is a block diagram of a typical construction of a display unit in which a sub field arrangement relating to the embodiments of this invention is applied.

FIG. 10 shows an example of a display apparatus in which the sub field arrangement of the aforesaid embodiments is applied.

In FIG. 10, 101, 102, 103 are respectively A/D conversion circuits for converting R, G, B signals to digital signals, 2 is a sub field conversion circuit wherein A/D converted binary digital signals are converted to sub field data representing illumination/non-illumination of sub fields, 200 is a control bit smoothing circuit provided in the sub field conversion circuit 2 which smoothes control bits corresponding to sub fields where address periods are compressed, 3 is a sub field sequential conversion circuit which converts sub field data expressed in pixel units into a surface sequence format in sub field units, 301 is a frame memory provided in the sub field sequential conversion circuit 3 which represents surface sequences in bit units, 4 is a drive circuit which, by inserting pulses necessary for driving, converts signals converted to a surface sequence format in sub field units into voltages (currents) for driving the display apparatus, 5 is a display panel on which different gradations are represented by the sub field scheme, and 6 is a control circuit for generating control signals required for each block such as a dot clock CK, horizontal sync signal H and vertical sync signal V which comprise timing information for the input image signal.

Herein, the input signals R, G, B signals are converted to digital signals by the A/D conversion circuits 101, 102, 103. These digital signals are based on ordinary binary expressions, each bit having a weighting of a power of 2. Specifically, when an 8-bit signal b0, b1, . . . b6, b7 is quantized, the least significant bit b0 has a weighting of 1, b1 has 2, b2 has 4, b3 has 8, and b7 has 128. The digital signals are converted into sub field data representing illumination/non illumination of sub fields by the sub field conversion circuit 2. This sub field data comprises information about numbers of bits corresponding to numbers of sub fields which display the image. If the image is displayed by eight sub fields, the data comprises an 8-bit signal S0, S1, . . . S7. The bit S0 shows whether or not the corresponding pixel emits light during the light-emitting period of the first sub field SF1, and likewise, S1, S2, . . . correspond in order to the sub fields SF2, SF3.

In the control bit smoothing circuit 200, smoothing is performed on the control bit corresponding to the sub field for which the address period is compressed. In other words, as addressing is performed using an identical control bit for two lines simultaneously, a conversion is performed so that the corresponding control bit comprises identical data for sub field data one line higher or sub field data one line lower which constitute a pair. This control bit smoothing will be described later. This sub field data is input into the sub field sequential conversion circuit 3, and written in pixel units in the frame memory 301 provided in the sub field sequential conversion circuit 3. In other words, one field portion of the bit S0 showing illumination or non-illumination of the sub field SF1 is read, the bit S1 showing illumination or non-illumination of the sub field SF2 is read and S2, S3, . . . S7 are read in sequence, and then these are output as address data to construct the sub fields. In this process, in sub fields where the address period is compressed, one line of two is thinned out and data corresponding to half the number of lines is read as address data. Subsequently, signal conversion and pulse insertion are performed by the drive circuit 4 to drive the display elements, and the matrix display panel 5 is thereby driven.

A scanning pulse output simultaneously with the address data of the address period is output with the timing shown in FIG. 2 in sub fields in which address processing is performed in ordinary line units, and output with the timing shown in FIG. 5 or FIG. 9 in sub fields where address processing is performed simultaneously for two lines and the control period is compressed.

Due to this construction, the address period can be shortened for predetermined sub fields, and a display apparatus having higher brightness or higher image quality than that of the prior art can be manufactured.

In the above construction, all the data was written into the frame memory 301, and one line in every two was thinned when the address period was compressed in the read stage, but thinning may instead be performed in the write stage. In this way, memory capacity can be reduced, or the image can be displayed with a higher resolution or more gradations using a memory of the same capacity.

When the number of sub fields is increased, or false contour interference reduction processing is performed by assigning a light emission weighting different to that of a power of 2, a conversion to a sub field light emission pattern is performed from the input image signal level in the sub field conversion circuit 2. For example, when an image signal input in 8 bits is displayed by 10 sub fields, the 8 bit input signal is converted to 10 bit sub field data by a combination of logic circuits or a lookup table.

Next, the construction of the control bit smoothing circuit 200 will be described referring to FIG. 11.

Figure 11:
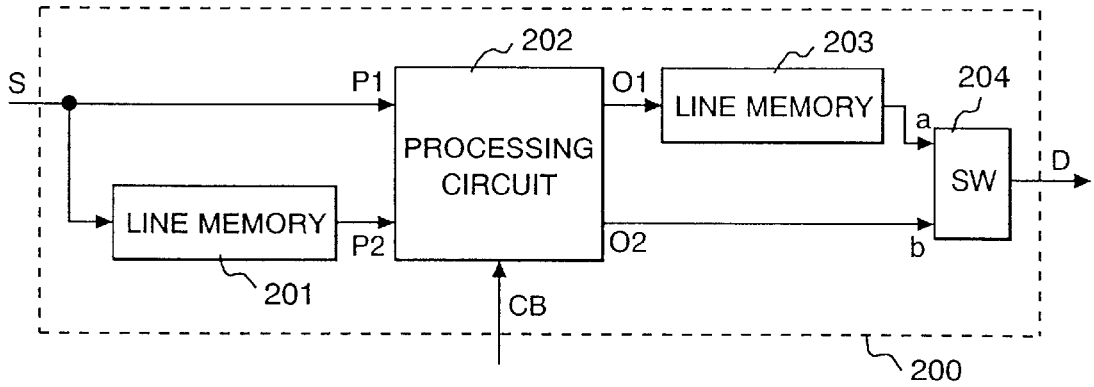
FIG. 11 is a block diagram of a typical construction of a smoothing circuit of FIG. 10.

In FIG. 11, 201 is a line memory for delaying sub field data by one line, 202 is a processing circuit for converting two inputs P1, P2 by a control signal CB so that specified bit data is the same, and outputting them as outputs 01, 02, 203 is a line memory for delaying the output 01 of the processing circuit 202 by one line, and 204 is a change-over circuit for changing over and outputting two inputs a, b in line units.

Herein, as sub field data S wherein illumination/non illumination of each sub field corresponds to bit data, the input P1 of the line memory 201 and processing circuit 202 is input. Sub field data delayed by one line by the line memory 201 is input to the input P2 of the processing circuit 202. In the processing circuit 202, a conversion is performed so that predetermined bit data is equal relative to sub field data for two vertically adjacent pixels for the present line and the immediately preceding line using sub field data from the input P1 and sub field data delayed by one line from the input P2. Sub field data on which this conversion processing has been performed is output by the processing circuit 202 as the outputs 01, 02. As the outputs 01, 02 of the processing circuit 202 are sub field data for vertically adjacent pixels on the screen, by delaying the output 01 by one line in the line memory 203 and changing over the change-over circuit 204 every line to sequentialize two line signals, the outputs are converted to sub field data D wherein predetermined bit data has the same value for two lines.

The position of the bit which is processed by the processing to circuit 202 to give the same bit data is determined by the control signal CB, and it is possible to set the sub field in which the address period is shortened. The setting when no address period shortening is performed at all is also performed by the control signal CB, in which case the input P1 is output as the output 01 without modification and the input P2 is output as the output 02 without modification by the processing circuit 202.

In the simplest arrangement of the processing circuit 202, predetermined bit data of the input P1 is output without modification as bit data at an identical position of the input P2. In this way, the two bit data can be made equal. Alternatively, bit data of the input P2 can be output as bit data at an identical position of the input P1. Either of these methods may be selected to minimize discrepancies from the input signal. Other arrangements may also be used provided that the bit data specified by the control signal CB is the same in the outputs 01, 02, and the difference from the input signal due to the conversion is small. In this case, the arrangement may also be such that signals other than the bits specified by the control signal CB are modified to make the difference from the input signal due to conversion small.

Figure 12:
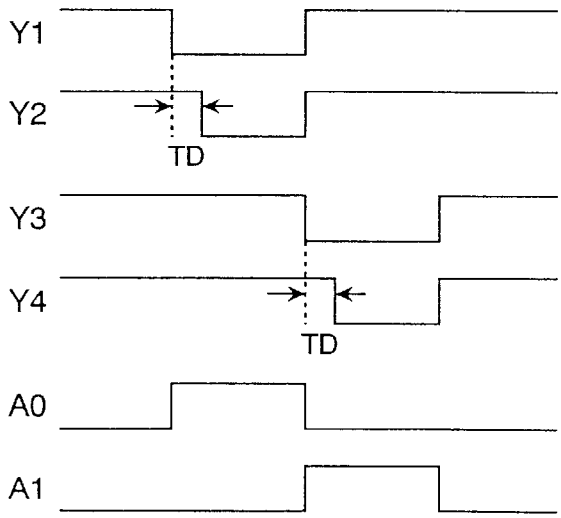
FIG. 12 is a figure showing another example of electrode applied voltages in an address period relative to the embodiments of this invention.

In the aforesaid embodiments, to shorten the address periods of specified sub fields, scanning pulses were applied to two lines simultaneously and address processing was performed on two lines together, as shown in FIG. 5 or FIG. 9. By performing this processing, the address periods can be shortened, but as a discharge occurs two lines at a time when address processing is performed, there is a problem in that the peak value of the address discharge current increases. To avoid this problem, FIG. 12 shows a case where pulses are applied at different times to two lines comprising Y1 sustain electrode and Y2 sustain electrode, or Y3 sustain electrode and Y4 sustain electrode pairs. Due to this arrangement, increase of peak discharge current can be suppressed, and the driver circuit can be made smaller and more compact which is economical. In this case, the address processing period may be delayed by a period TD compared to the usual address timing. Alternatively, as it may be expected, due to the priming effect which accompanies adjacent pixel discharges of the Y1 sustain electrode and Y3 sustain electrode, that the discharge timing of latter lines of the Y2 sustain electrode and Y4 sustain electrode will be advanced, the scanning pulse width of latter lines may be made narrower with the usual address processing period. As a result of this arrangement, the address period can be shortened at a peak discharge current which is of the same order as in the prior art. FIG. 12 shows the case where the Y1 sustain electrode and Y2 sustain electrode, and Y3 sustain electrode and Y4 sustain electrode, are combined in pairs two lines at a time, but instead of two lines, three lines or four lines may be processed simultaneously. In this case also, scanning pulses may be applied with different timings so that the address discharges are not duplicated. The situation is the same when line pairs are staggered, as in the case of the Y2 sustain electrode and Y3 sustain electrode, and the Y4 sustain electrode and Y5 sustain electrode, and scanning pulses for latter lines may be applied with a certain delay.

Figure 13:
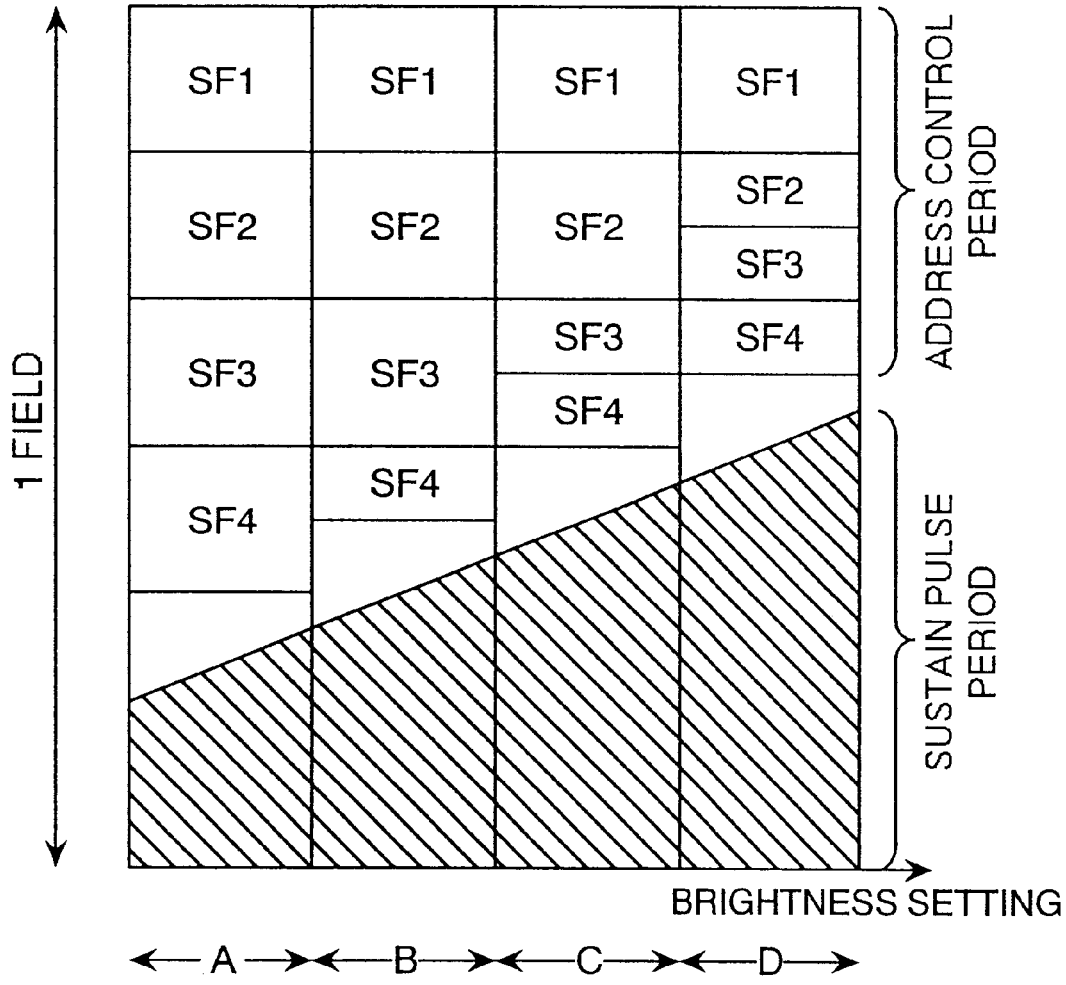
FIG. 13 is a display mode descriptive drawing when address periods are shortened according to this invention.

Next, FIG. 13 shows the relation between a high resolution/low brightness display mode when no shortening of address period is performed, and a low resolution/high brightness display mode when the address period is shortened for a relatively large number of sub fields, in the case of the display apparatus of this invention.

In FIG. 13, the vertical axis shows the time axis, and represents a time distribution of the processing assigned in one field period. The horizontal axis shows the set values of maximum brightness, and shows that the time distribution of sub fields SF1–SF4 changes between four modes A, B, C, D according to the setting range of this maximum brightness. Herein, SF1, SF2, SF3, SF4 represent the address periods of the respective sub fields SF1–SF4, and the shaded regions represent the total number of sustain pulses of all sub fields in one field period.

As shown in FIG. 13, in the region A which has a low maximum brightness setting, all sub fields are displayed without shortening address periods. In the region B which has a slightly higher set brightness, the address period of the sub field SF4 is shortened, and the resulting free time is assigned to the sustain period to achieve high brightness. In the case where the maximum brightness setting is increased in regions C and D, the address periods of the sub fields SF3 and SF2 are successively shortened to 1/2 in addition to the lowermost sub field SF4, and a sustain period which can achieve the set brightness is obtained.

In this example, the case is shown where the address period was shortened to 1/2, but it may be shortened to 1/3 or 1/4. Alternatively, after first shortening to 1/2, the setting may be changed to 1/3 or 1/4 to further lengthen (extend) the sustain period and achieve improved brightness.

In the display apparatus of the prior art, shortening of address period was not performed and consequently only the sustain period/brightness corresponding to region A shown in FIG. 13 could be used. According to this invention, display resolution information is limited as necessary as in the case of B, C, D, and higher brightness is possible due to the extended sustain period.

Further, according to this invention, a still wider range of brightness settings is possible depending on the brightness of the environment where the display apparatus is situated, on user settings and on image signal levels, and a high-quality, high brightness display apparatus can be produced. Hence, any image quality can be easily obtained according to image and user objectives, e.g., in computer monitors, high resolution is required without demanding high brightness, whereas in the case of films or video displays, a bright, lively display is desired without the need for such high resolution.

The aforesaid embodiments are all based on the method where address and sustain are separate, but the same effect can be obtained by shortening the address periods even in multi-drive systems where the address and sustain periods overlap in the field.

This invention may also be applied, by varying the positions of light emitting lines for each field relative to an interlaced input signal, to the plasma display apparatus disclosed in Japanese Unexamined Patent Publication No. Hei 9-160525 which displays an interlaced scanning signal.

Figure 14:
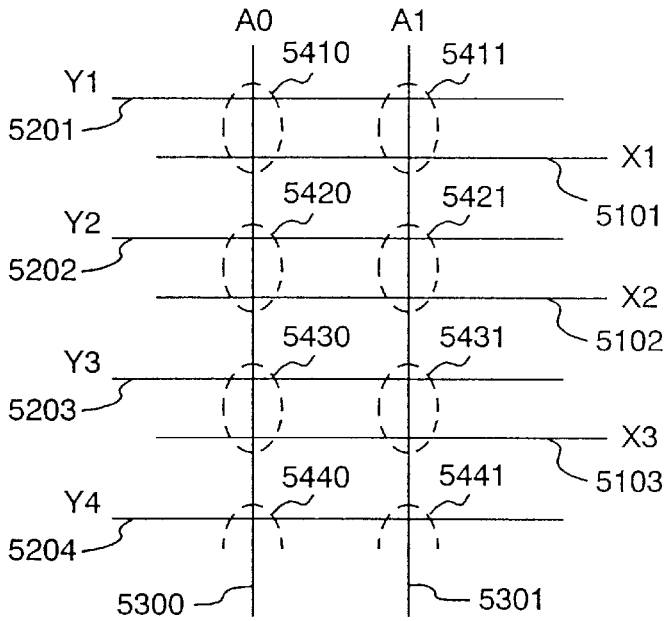
FIG. 14 is a schematic layout diagram of discharge cells and electrodes in the case of odd field display of a plasma display which performs interlacing.
Figure 15:
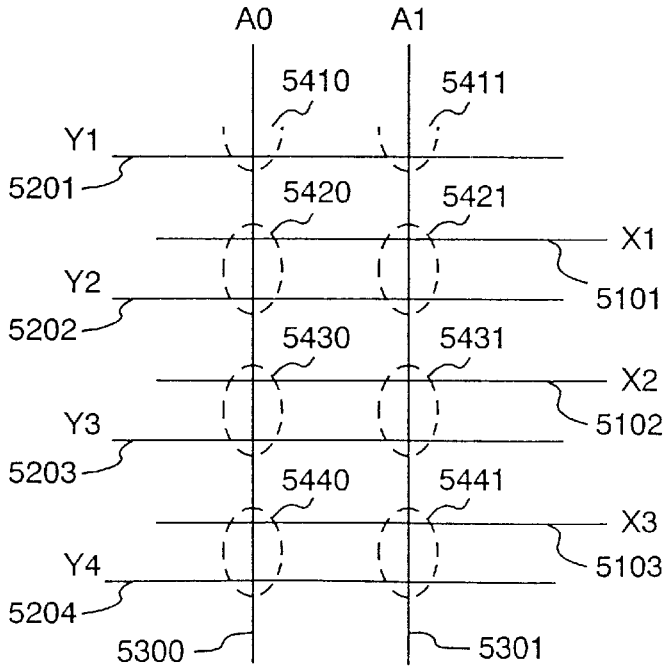
FIG. 15 is a schematic layout diagram of discharge cells and electrodes in the case of even field display of a plasma display which performs interlacing.

FIG. 14 and FIG. 15 schematically show the layout of discharge cells and electrodes in a plasma display which performs interlacing. FIG. 14 shows the case of odd fields, and FIG. 15 shows the case of even fields.

In FIG. 14 and FIG. 15, 5101, 5102, 5103, 5104 are X sustain electrodes, 5201, 5202, 5203, 5204 are Y sustain electrodes, and 5300, 5301 are address electrodes. The address electrodes 5300, 5301 are formed on a rear face plate, while the X sustain electrodes 5101–5104 and Y sustain electrodes 5201–5204 are formed on a front face plate.

To produce an interlaced scanning display, when an odd field is displayed, pixels are formed by discharge light emission between the Y sustain electrodes and X sustain electrodes 5201–5101, 5202–5102, 5203–5103 as shown in FIG. 14. Likewise, when an even field is displayed, pixels are formed by discharge light emission between the X sustain electrodes and Y sustain electrodes 5101–5202, 5102–5203, 5103–5204 as shown in FIG. 15. In this way, an interlaced scanning display is produced by offsetting the positions of light-emitting pixels in odd/even fields of an interlacing signal.

The positions of light-emitting pixels in odd fields and even fields are controlled by the phase of the sustain pulses applied to the X sustain electrode and Y sustain electrode, and light emission/non-light emission of pixels in corresponding sub fields is controlled by address discharge between the address electrodes 5300, 5301, and Y sustain electrodes 5201, 5202, 5203, 5204. In other words, the control of light emission/non-light emission of a pixel 5410 is determined by address discharge between the Y sustain electrode 5201 and address electrode 5300 for both odd fields and even fields, and whether the pixel is formed at the position shown in FIG. 14 or at the position shown in FIG. 15 is determined by the conditions under which the subsequent sustain pulse is applied. Therefore, the function of the address periods is the same as in the prior art plasma display shown in FIG. 2 for both even fields and odd fields, sequential scanning pulses being applied to the Y electrodes, and the address electrodes A0, A1 being controlled according to the light emission/non-light emission of pixels.

Therefore, the technique of the present invention whereby plural lines are simultaneously addressed by identical data to shorten the address period may also be applied to a prior art plasma display. In this case, lower SF data of adjacent plural lines which are input in an interlaced format in the field are shared, and for image signals synthesized in one frame, images are distant from each other in a vertical direction and image correlation is low. As a result, compared to a prior art sequential scanning plasma display, the number of lines having identical data is no more than two, and sub fields having the same data are limited to those with a low light-emission weighting, so visible image deterioration is prevented.

Next, the construction and operation of the processing circuit 202 of the control bit smoothing circuit 200 will be described referring to FIG. 16 and FIG. 17.

Figure 16:
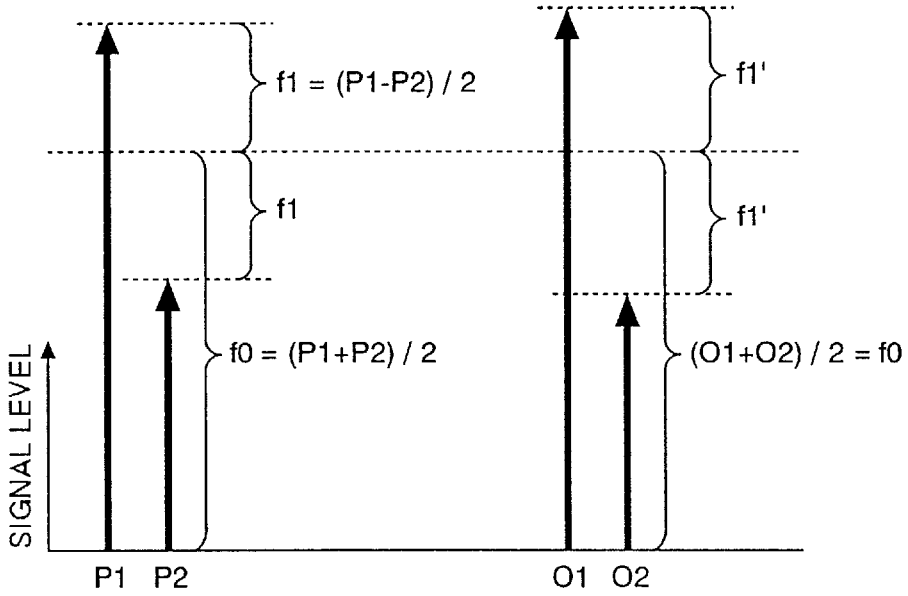
FIG. 16 is an operating mode diagram of a processing circuit 202 shown in FIG. 11.

FIG. 16 schematically shows pixel amplitudes of the signals P1, P2 input to the processing circuit 202, which are signals for two adjacent lines, and the pixel amplitude of the processing outputs 01, 02.

As lower bits have the smallest error due to interconversion with input pixels (the input image?), and desired lower bits are shared by adjacent pixels, the average to value f0 of input signals and the value f1 based on their difference may be calculated by the following equations (1) and (2), $$f0=(P1+P2)/2 \quad (1)$$

$$f1=(P1-P2)/2 \quad (2)$$

Next, the lower n bits of f1 are converted (quantized) to become 0, which will be written as f1'. Using this f1', the output signals 01, 02 are found by the following equations (3), (4), $$O1=f0+f1' \quad (3)$$

$$O2=f0-f1' \quad (4)$$

As the lower n bits of f1' are 0, the lower n bits of O1, O2 obtained by addition or subtraction of f0 are output as values wherein the lower n bits of f0 are unchanged. In other words, the lower n bits of O1, O2 can be treated as equal data. Strictly speaking, when there is no carrying or borrowing from the lower bits, addition and subtraction give the same result (square law computation (modulus 2)), so the data in the lower n+1 bits can be converted to be the same in O1, O2. The average value (O1+O2)/2 of the outputs O1, O2 is then always equal to the average value f0 of the inputs P1, P2, so the average signal level of plural lines, e.g. two adjacent lines, can be maintained the same. Further, the error involved in sharing the lower bits is scattered in (|f1−f1'|) units equally between O1, O2, so there is no built-up of conversion error in specific pixels, and the mean square deviation between the input image and the image after conversion can be minimized. When f1=f1', it is clear that P1=O1, P2=O2, so the question of whether the lower few bits should be shared can be determined by the quantizing characteristics of a quantizing circuit 207 from f1 to f1'.

Next, the layout of the processing circuit 202 will be described referring to FIG. 17.

Figure 17:
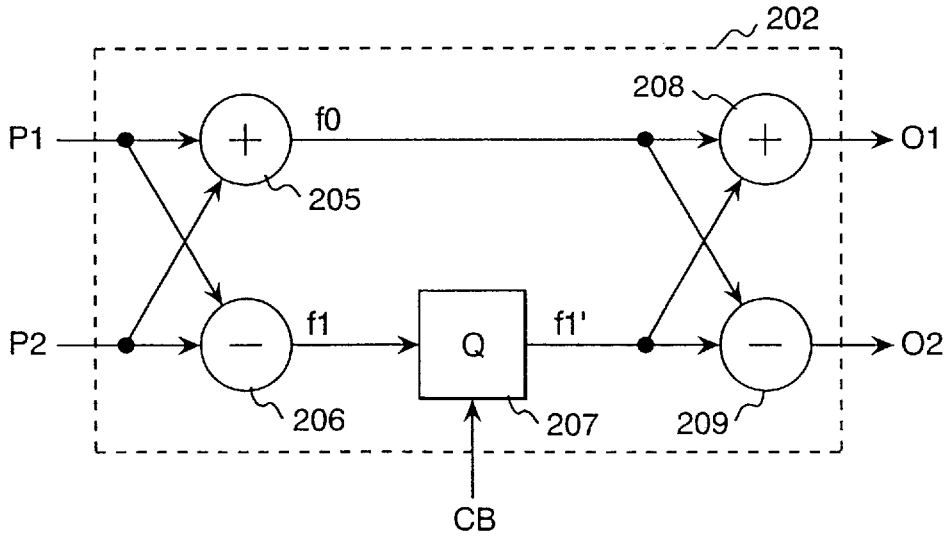
FIG. 17 is a block diagram of a typical arrangement of the processing circuit 202 shown in FIG. 11.

In FIG. 17, 205, 208 are addition circuits, 206, 209 are subtraction circuits, 207 is the quantizing circuit whereof the characteristics vary according to the external control signal CB, and 202 is the processing circuit. The vertically adjacent pixels P1, P2 input by the processing circuit are input to the addition circuit 205 and subtraction circuit 206. In the addition circuit 205, addition of P1 and P2 is performed, and the average value f0 is computed as shown by Equation (1). In the subtraction circuit 206, the subtraction P1−P2 is performed, and the value f1 is calculated based on the difference shown in Equation (2). fl is input to the quantizing circuit 207 and converted to f1'. The quantizing circuit 207 performs processing so that the lower bits specified by the control signal CB are "0". The signal f1', wherein desired lower bits have been converted to 0 by the control signal CB, is added to to generated by the addition circuit 205 in the addition circuit 208. and the result is output as the conversion output O1. In the subtraction circuit 209, f0 is subtracted from f1', and the result is output as the conversion output O2. Due to the above arrangement, image deterioration can be kept to a minimum, and lower bit data of two lines can be shared.

It may be noted that by discarding the lower bits, the computational processing can be reduced to 1/2. Although not shown, this may be reduced to 1/2 by the outputs of the addition circuit 205 and subtraction circuit 206, as shown in Equations (1) and (2). Alternatively, to reduce rounding errors in the computation step, it may be reduced to 1/2 in the output parts of the addition circuit 208 and subtraction circuit 209. The quantizing characteristics of the quantizing circuit 207 are controlled by the control signal CB, so the question of which lower bits and how many bits are shared, is controlled by the setting of the external CB.

It may be considered that the average signal level f0 of two lines shown here is a low frequency component in the vertical direction of the image, and the value f1 based on the difference of the two lines is a high frequency component in the vertical direction. Due to the quantizing circuit 207, the high frequency component f1 in the vertical direction is "0" relative to the sub field corresponding to the lower bits, so the signal comprises only the low frequency component f0. In this way, in the lower sub fields, the vertical resolution is limited to only the low frequency component f0, the number of data in the address period is thinned, and simultaneous addressing can be performed using identical data.

By dividing into plural vertical frequency components and selecting or recombining addition or subtraction bits by quantizing as described above, the resolution information in specific sub fields corresponding to desired bits can be limited, and address periods can thus be shortened. This is the characteristic feature of this invention.

Hereabove, the processing was described for signals of two adjacent lines, but data corresponding to lower sub fields may also be shared among plural lines regardless of whether they are adjacent or not adjacent.

The arrangement of the processing circuit 202 when this is extended to four lines will now be described.

Figure 18:
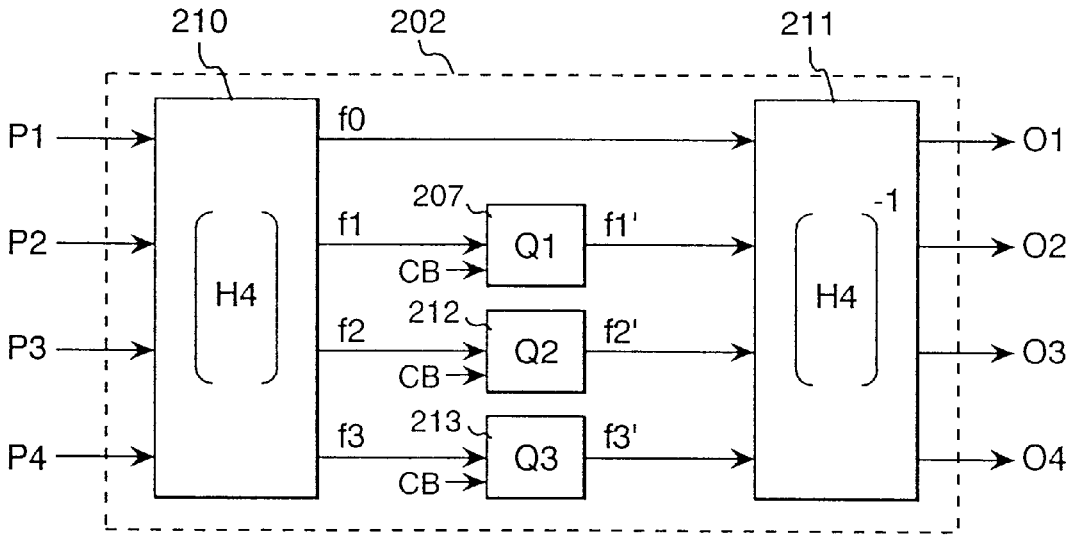
FIG. 18 is a block diagram of another typical arrangement of the processing circuit 202.
Figure 18:
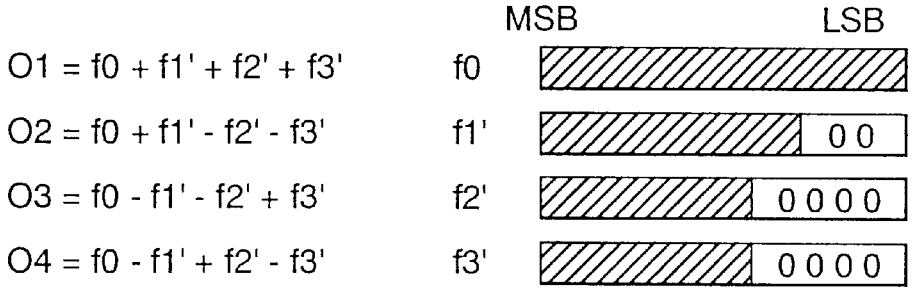

FIG. 18 is an example of the processing circuit 202 used for extension to four lines. The bit smoothing circuit 200 shown in FIG. 11 allows two line signals to be processed simultaneously, but the processing circuit 202 shown in FIG. 18 is installed inside a bit smoothing circuit, not shown, which allows pixels in four continuous lines in one field to be processed simultaneously.

In FIG. 18, 210 is a fourth order Hadamard transform circuit which converts vertically adjacent pixels P1, P2, P3, P4 to four frequency components f0, f1, f2, f3, 211 is a fourth order Hadamard inverse transform circuit which performs an inverse transformation to convert four frequency components f0, f1', f2', f3' to output pixels O1, O2, O3, O4, 207 is the quantizing circuit which converts the low frequency component f1 into f1', 212 is a quantizing circuit which converts the frequency component f2 to f2', and 213 is a quantizing circuit which converts the frequency component f3 to f3'.

The vertically continuous pixels P1, P2, P3, P4 are decomposed into the four frequency components f0, f1, f2, f3 by the Hadamard transform circuit 210. f0 is the average (direct current component) of four pixels showing the high frequency components f1, f2, f3. Subsequently, f1, f2, f3 are respectively input to the quantizing circuits 207, 212, 213, and quantization is performed according to quantizing characteristics determined by the control signal CB. In the example shown in FIG. 18, these components are quantized so that the lower two bits of f1' are "0", and the lower four bits of f2', f3' are "0".

In the Hadamard inverse transform circuit 211, output pixels are generated and output from the frequency component f0 and quantized f1', f2', f3'.

The computing process for the output pixels O1, O2, O3, O4 performed by the Hadamard inverse transform circuit 211 is shown by the following equations (5)–(8).

$$O1=(f0+f1')+(f2'+f3') \quad (5)$$

$$O2=(f0+f1')-(f2'+f3') \quad (6)$$

$$O3=(f0-f1')-(f2'-f3') \quad (7)$$

$$O4=(f0-f1')+(f2'-f3') \quad (8)$$

In the arrangement shown in FIG. 18, the quantizing characteristics of the quantizing circuit 212 relative to f2, and the quantizing characteristics of the quantizing circuit 213 relative to f3, are set to be equal, and converted so that the lower four bits of f2', f3' are 0. As a result, the lower four bits in the computation results of (f2'+f3') and (f2'−f3') are "0". Further, f1' is converted so that the lower two bits are "0". From these conditions, as the output pixels O1–O4 are computed by adding or subtracting f0, f1', (f2'+f3') or (f2'−f3'), the values of the lower two bits of f0 are output without modification, and the lower two bits of data are equal for four pixels.

Next, comparing O1 and O2, as these pixels are obtained by adding or subtracting (f2'+f3'), wherein the lower four bits are "0", to or from (f0+f1') in addition to the lower four bits, the data is identical up to the fifth lower bit obtained by addition or subtraction without carrying or borrowing from the lower bits. Likewise, comparing O3 and O4, as these pixels are obtained by adding or subtracting (f2'−f3'), wherein the lower four bits are "0", to or from (f0−f1'), in addition to the lower four bits, the data is identical up to the lower five bits by addition or subtraction without carrying or borrowing from the lower bits. In other words, due to the setting of the quantizing characteristics shown in FIG. 18, from the fifth lower bit to to the third lower bit, the data is the same in two line units of O1, O2, O3 and O4, and for the second lower bit and first lower bit, all the data can be made the same from O1–O4.

Due to the above processing, the two sub fields corresponding to the second lower bit may be simultaneously addressed in four lines by identical data, and in the three sub fields corresponding to the region from the fifth lower bit to the third lower bit, simultaneous addressing may be performed in two lines by identical data. As a result, the address period of the sub field corresponding to the region from the fifth lower bit to the third lower bit can be shortened to 1/2, and the address period of the second lower bit and first lower bit can be shortened to 1/4.

To make the input/output amplitude range the same, 1/4 of the computational processing is required, but as in the case of the example shown in FIG. 17, it can be achieved without any special hardware layer by setting the effective bits of the computing data, and is therefore omitted here. This may be done for example by making f0–f3 equal to 1/4 in the output stage of the orthogonal transform circuit 210, or by making the amplitudes of the output pixels O1–O4 equal to 1/4.

The processing techniques shown in FIG. 17 and FIG. 18 coincide with compression and decoding (expanding a compressed signal) of image data using an orthogonal transform (Hadamard transform), and this is similar to the method where the quantizing is made coarser the higher the frequency components (f2, f3) are compared to the direct current component (f0).

In other words, quantized bit distribution know-how acquired from image compression in the prior art is applied here, and a conversion is performed so that image deterioration is hardly visible.

When an image signal, which has been compressed by an image compression technique using orthogonal transform, recorded and transmitted, is subsequently decoded, if the address period is first compressed, there is less missing information in the compressed transmission step, so a display with little image deterioration can therefore be achieved in practice.

By dividing the input signal into plural resolution information and limiting the resolution information of specific sub fields as described above, the address period can be shortened.

By dividing into four vertical frequency components, selecting addition and subtraction bits by a quantizing means and recombining them, specific resolution information corresponding to desired bits can be limited, and consequently the address control period can be shortened. Further, sub field and resolution limits can be controlled by varying the quantizing characteristics of frequency components by the control signal CB.

The recombination of pixels from plural, divided frequency components is performed by a linear combination with a coefficient of "1" or "−1" as shown in Equations (3), (4), and (5)–(8). As a result, bits selected by the quantizing means are directly reflected in output pixels, and resolution information in specific sub fields corresponding to desired bits can easily be limited. In practice, a coefficient of 1/2 or 1/4 is applied to make the input/output amplitude range the same, and if the combination of output pixels is such that the coefficient of frequency components is "K" or "−K", setting limits on resolution information in specific sub fields corresponding to desired bits is easy to accomplish by setting the quantizing characteristics. Therefore, orthogonal transforms other than a Hadamard transform can be used provided that there are linear combinations using the two coefficients "K", "−K".

According to this invention, address periods are shortened according to a required brightness, and the time thus gained can be allocated to improving image quality such as brightness, gradation and false contour.

By thinning data in lower sub fields having a relatively small light-emission weighting, image deterioration can be reduced.

By thinning data in lower sub fields excluding sub fields having the lowest light-emission weighting, pseudo-intermediate gradations such as dither or error scatter processing may also be displayed.

To obtain a high brightness display, data is thinned in a large number of sub fields and more time is assigned to the sustain period, whereas for a low brightness/high detail display, sub fields with data thinning are reduced or completely eliminated. Hence, an image quality suited to the image content and user's intention can be obtained.

Further, by dividing an input image signal into vertical frequency components, limiting the display resolution information and shortening the time for which illuminated pixels are controlled, a high-quality display which is not prone to image deterioration can be realized.

This invention may also be applied to other embodiments apart from those described above without departing from the spirit or main features thereof. The above embodiments are therefore intended as examples in every aspect, and should not be construed as limiting. The scope of this invention is shown by the range of appended claims. Further, changes and modifications within the scope of the appended claims are all within the scope of this invention.

What is claimed is:

1. A display apparatus which displays an image by illuminating pixels of a display unit, the apparatus comprising an input signal processing circuit which processes an input image signal, a control circuit which controls display resolution information of an image displayed on the display unit and a drive circuit which drives the display unit based on the outputs of the input signal processing circuit and control circuit, wherein an image corresponding to the input image signal is displayed by driving the display unit with the drive circuit when the display resolution information is limited by the control circuit, and the illuminated pixel selection time of the display unit is shortened.

2. A display apparatus according to claim 1, wherein said control circuit controls said display resolution information by selecting, processing and combining elements obtained by splitting said display resolution information into plural frequency components.

3. A display apparatus according to claim 2, wherein said control circuit multiplies said selected frequency components by a coefficient K, −K, and adds said components.

4. A display apparatus using a sub field which illuminates addressed pixels of a display unit to display an image, comprising an image signal processing circuit which performs sub field conversion processing on an input image signal, a control circuit which controls display resolution information of an image displayed on the display unit and a drive circuit which addresses and illuminates pixels of the display unit based on the outputs of the input signal processing circuit and control circuit, wherein an image corresponding to the input image signal is displayed by driving the display unit with the drive circuit when the display resolution information is limited by the control circuit, and the address periods which select the illuminated pixels of the display unit are shortened.

5. A display apparatus according to claim 4, wherein said control circuit shortens said address periods for one or more sub fields comprising the lowermost sub field having the minimum light-emission weighting.

6. A display apparatus according to claim 4, wherein said control circuit shortens said address periods for one or more lower sub fields excluding the lowermost sub field having the minimum light-emission weighting.

7. A display apparatus according to claim 4, wherein said control circuit is able to control the number of sub fields for which said address periods are shortened by a setting from outside the display apparatus.

8. A display apparatus according to claim 4, wherein said control circuit controls said display resolution information by selecting, processing and combining elements obtained by splitting said display resolution information into plural frequency components.

9. A display apparatus according to claim 8, wherein said control circuit multiplies said selected frequency components by a coefficient K, −K, and adds said components.

10. A display apparatus using a sub field which illuminates addressed pixels of a display unit to display an image, comprising a display unit on which the pixels are arranged in plural lines, an image signal processing circuit which converts an input image signal into sub field data showing illumination or non-illumination of each sub field, a smoothing circuit which performs control so that bit data of the sub field data are arranged in the plural lines of the display unit, a control circuit which controls address periods of the sub fields so as to arrange the bit data, and a drive circuit which addresses and illuminates pixels of the display unit based on the outputs of the image signal processing circuit, smoothing circuit and control circuit, wherein the image is displayed by driving the plural lines of the display unit while controlling address periods in predetermined sub fields, and arranging the bit data.

11. A display apparatus according to claim 10, wherein said plural lines are simultaneously addressed by identical data.

12. A display apparatus according to claim 10, wherein said control circuit simultaneously addresses pixels in one or more sub fields including the lowermost sub field having the minimum light-emission weighting, and shortens said address periods.

13. A display apparatus according to claim 10, wherein said control circuit simultaneously addresses pixels in one or more lower sub fields excluding the lowermost sub field having the minimum light-emission weighting, and shortens said address periods.

14. A display apparatus according to claim 10, wherein combinations of said plural lines vary in field or frame units.

15. A display apparatus according to claim 10, wherein combinations of said plural lines are different between sub fields in one field.

16. A display apparatus according to claim 10, wherein the number of sub fields in which said address periods are controlled, may be controlled from outside the display apparatus.

17. A display apparatus according to claim 10, wherein the number of lines for which said address periods are controlled, may be controlled from outside the display apparatus.

18. A display apparatus according to claim 10, wherein said plural lines are two lines.

19. A display apparatus according to claim 10, wherein signal processing of said plural lines in said smoothing circuit comprises the splitting of sub field data into plural vertical components, selecting them and combining them.

20. A display apparatus according to claim 19, wherein said smoothing circuit multiplies said split frequency components by a coefficient K, −K, and adds said components.

21. A display apparatus using a sub field which illuminates addressed pixels of a display unit to display an image, comprising a display unit on which the pixels are formed in intersecting parts where a first line electrode and second line electrode are arranged to intersect, a conversion circuit which converts an input image signal to sub field data, a smoothing circuit which performs control so that bit data of the sub field data are arranged in plural lines of the second line electrode of the display unit, a control circuit which controls address periods of the sub fields in which the bit data are arranged, and a drive circuit which forms a drive signal that drives the display unit based on the output of the control circuit, addresses pixels by driving at least the first line electrode and illuminates the addressed pixels by driving the second line electrode, wherein the image is displayed by driving the plural lines of the second line electrode of the display unit while controlling address periods in predetermined sub fields, and arranging the bit data.

22. A display method for displaying an image by illuminating pixels of a display unit, comprising an input signal processing step for processing an input image signal, a control step for controlling display resolution information of an image displayed on the display unit and a drive step for driving the display unit based on the outputs formed by the input signal processing step and control step, wherein an image corresponding to the input image signal is displayed by driving the display unit when the display resolution information is limited and the illuminated pixel selection time of the display unit is shortened.

23. A display method using a sub field for illuminating addressed pixels of a display unit to display an image, comprising an image signal processing step for performing sub field conversion processing on an input image signal, a control step which controls display resolution information of an image displayed on the display unit, and a drive step which addresses and illuminates pixels of the display unit based on the outputs of the input signal processing step and control step, wherein an image corresponding to the input image signal is displayed by driving the display unit when the display resolution information is limited by the control circuit, and the address periods which select the illuminated pixels of the display unit are shortened.

24. A display method using a sub field for addressing and illuminating pixels of a display unit on which the pixels are arranged in plural lines so as to display an image, comprising a step for inputting an image signal, an image signal processing step for converting an input image signal into sub field data showing illumination or non-illumination of each sub field, a smoothing step for performing control so that bit data of the sub field data are arranged in the plural lines, a control step for controlling address periods of the sub fields in which the bit data are arranged, and a drive step for addressing and illuminating pixels of the display unit based on the outputs of the image signal processing step, smoothing step and control step, wherein the image is displayed by driving the plural lines of the display unit while controlling address periods in predetermined sub fields, and arranging the bit data.

25. A display method according to claim 24, wherein said plural lines are simultaneously addressed by identical data.

26. A display method according to claim 24, wherein said control step simultaneously addresses pixels in one or more sub fields including the lowermost sub field having the minimum light-emission weighting, and shortens said address periods.

27. A display method according to claim 24, wherein said control circuit simultaneously addresses pixels in one or more lower sub fields excluding the lowermost sub field having the minimum light-emission weighting, and shortens said address periods.

28. A display method according to claim 24, wherein combinations of said plural lines vary in field or frame units.

29. A display method according to claim 24, wherein combinations of said plural lines are different between sub fields in one field.

30. A display method according to claim 23, wherein the number of sub fields in which said address periods are controlled, may be controlled from outside the display apparatus.

31. A display method according to claim 24, wherein the number of lines for which said address periods are controlled, may be controlled from outside the display apparatus.

32. A display method according to claim 24, wherein said plural lines are two lines.

33. A display method according to claim 24, wherein signal processing of said plural lines in said smoothing step comprises the splitting of bit data into plural vertical components, selecting them and combining them.

34. A control-drive circuit for driving a display apparatus which displays an image by illuminating pixels of a display unit, the control-drive circuit comprising an input signal processing circuit rich processes an input image signal, a control circuit which controls display resolution information of an image displayed on the display unit, and a drive circuit which drives the display unit based on the outputs of the input signal processing circuit and control circuit to illuminate the pixels, wherein the display resolution information is limited by the control circuit, and the illuminated pixel selection time of the display unit is shortened.

35. A control-drive circuit for driving a display apparatus using a sub field which illuminates addressed pixels of a display unit to display an image, comprising an image signal processing circuit which performs sub field conversion processing on an input image signal, a control circuit which controls display resolution information of an image displayed on the display unit, and a drive circuit which addresses and illuminates pixels of the display unit based on the outputs of the input signal processing circuit and control circuit, wherein the display resolution information in predetermined sub fields is limited by the control circuit, and the address periods of the display unit are shortened by the drive circuit.

36. A control-drive circuit for a display apparatus using into a sub field which illuminates addressed pixels of a display unit to display an image, comprising an image signal processing circuit which converts an input image signal into sub field data showing illumination or non-illumination of each sub field, a smoothing circuit which performs control so that bit data of the sub field data are arranged in plural lines of the display unit, a control circuit which controls address periods of the sub fields to arrange the bit data, and a drive circuit which addresses and illuminates pixels of the display unit based on the outputs of the image signal processing circuit, smoothing circuit and control circuit, wherein a drive output which controls address periods in predetermined sub fields and arranges bit data is obtained as an output for driving the plural lines of the display unit.

* * * * *